US009669617B2

(12) United States Patent
Van Ostrand

(10) Patent No.: US 9,669,617 B2
(45) Date of Patent: Jun. 6, 2017

(54) ANILOX ROLL WITH LOW SURFACE ENERGY ZONE

(71) Applicant: Eastman Kodak Company, Rochester, NY (US)

(72) Inventor: Daniel K. Van Ostrand, Austin, TX (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/296,103

(22) Filed: Oct. 18, 2016

(65) Prior Publication Data

US 2017/0036439 A1 Feb. 9, 2017

Related U.S. Application Data

(62) Division of application No. 14/611,490, filed on Feb. 2, 2015.

(51) Int. Cl.
*B41F 31/26* (2006.01)
*B41F 5/24* (2006.01)

(52) U.S. Cl.
CPC ..... *B41F 31/26* (2013.01); *B41F 5/24* (2013.01)

(58) Field of Classification Search
CPC ..... B41F 5/24; B41F 31/26
USPC ..... 101/483
See application file for complete search history.

(56) References Cited

U.S. PATENT DOCUMENTS

| | | | |
|---|---|---|---|
| 4,566,938 | A | 1/1986 | Jenkins et al. |
| 4,939,992 | A | 7/1990 | Bird |
| 4,960,050 | A | 10/1990 | Hatch |
| 2008/0240794 | A1 | 10/2008 | Prior |
| 2014/0349013 | A1 | 11/2014 | Ramakrishnan et al. |

FOREIGN PATENT DOCUMENTS

| | | |
|---|---|---|
| DE | 3713027 | 11/1988 |
| WO | 2013/063188 | 5/2013 |

OTHER PUBLICATIONS

Attension, Theory Note 7—Influence of surface roughness on contact angle and wettability.
S. Giljean et al.; New insights on contact angle/roughness dependence on high surface energy materials, Applied Surface Science, Jun. 23, 2011, 9631-9638, 257, Elsevier.

*Primary Examiner* — Leslie J Evanisko
(74) *Attorney, Agent, or Firm* — Kevin E. Spaulding

(57) ABSTRACT

An anilox roll with low surface energy zone includes a cylinder having a curved contact surface, an ink transfer zone formed on a first portion of the curved contact surface, and a low surface energy zone formed on a second portion of the curved contact surface. The ink transfer zone includes a plurality of cells configured to transfer ink. The low surface energy zone includes a hydrophobic surface with a contact angle of at least 75 degrees and a surface roughness of less than 100 micrometers.

10 Claims, 13 Drawing Sheets

ANILOX ROLL WITH LOW SURFACE ENERGY ZONE

CROSS REFERENCE TO RELATED APPLICATIONS

This application is a Divisional of prior U.S. patent application Ser. No. 14/611,490, filed Feb. 2, 2015, which is hereby incorporated herein by reference in its entirety.

BACKGROUND OF THE INVENTION

A touch screen enabled system allows a user to control various aspects of the system by touch or gestures on the screen. For example, a user may interact directly with one or more objects depicted on a display device by touch or gestures that are sensed by a touch sensor. The touch sensor typically includes a conductive pattern disposed on a substrate configured to sense touch. Touch screens are commonly used in consumer, commercial, and industrial systems.

BRIEF SUMMARY OF THE INVENTION

According to one aspect of one or more embodiments of the present invention, an anilox roll with low surface energy zone includes a cylinder having a curved contact surface, an ink transfer zone formed on a first portion of the curved contact surface, and a low surface energy zone formed on a second portion of the curved contact surface. The ink transfer zone includes a plurality of cells configured to transfer ink. The low surface energy zone includes a hydrophobic surface with a contact angle of at least 75 degrees and a surface roughness of less than 100 micrometers.

According to one aspect of one or more embodiments of the present invention, a method of multi-station flexographic printing includes printing an image on a substrate using a first flexographic printing station. The first flexographic printing station includes a first anilox roll that consists of a first ink transfer zone. The method also includes, for each subsequent flexographic printing station, printing an image on the substrate. Each subsequent flexographic printing station includes a second anilox roll that includes a second ink transfer zone formed on a first portion of a curved contact surface of the second anilox roll and a low surface energy zone formed on a second portion of the curved contact surface of the second anilox roll. Each ink transfer zone includes a plurality of cells configured to transfer ink. The low surface energy zone includes a hydrophobic surface with a contact angle of at least 75 degrees and a surface roughness of less than 100 micrometers.

Other aspects of the present invention will be apparent from the following description and claims.

DETAILED DESCRIPTION OF THE INVENTION

Figure 1:
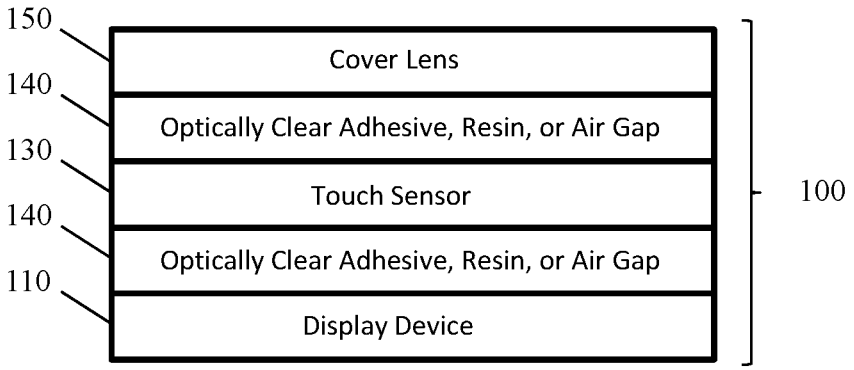
FIG. 1 shows a cross section of a touch screen in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

FIG. 1 shows a cross-section of a touch screen 100 in accordance with one or more embodiments of the present invention. Touch screen 100 includes a display device 110. Display device 110 may be a Liquid Crystal Display ("LCD"), Light-Emitting Diode ("LED"), Organic Light-Emitting Diode ("OLED"), Active Matrix Organic Light-Emitting Diode ("AMOLED"), In-Plane Switching ("IPS"), or other type of display device suitable for use as part of a touch screen application or design. In one or more embodiments of the present invention, touch screen 100 may include a touch sensor 130 that overlays at least a portion of a viewable area of display device 110. The viewable area of display device 110 may include the area defined by the light emitting pixels (not shown) of the display device 110 that are typically viewable to an end user. In certain embodiments, an optically clear adhesive or resin 140 may bond a bottom side of touch sensor 130 to atop, or user-facing, side of display device 110. In other embodiments, an isolation layer, or air gap, 140 may separate the bottom side of touch sensor 130 from the top, or user-facing, side of display device 110. A cover lens 150 may overlay atop, or user-facing, side of touch sensor 130. Cover lens 150 may be composed of glass, plastic, film, or other material. In certain embodiments, an optically clear adhesive or resin 140 may bond a bottom side of cover lens 150 to the top, or user-facing, side of touch sensor 130. In other embodiments, an isolation layer, or air gap, 140 may separate the bottom side of cover lens 150 and the top, or user-facing, side of touch sensor 130. A top side of cover lens 150 may face the user and protect the underlying components of touch screen 100. In one or more embodiments of the present invention, touch sensor 130, or the function that it implements, may be integrated into the display device 110 stack (not independently illustrated). One of ordinary skill in the art will recognize that touch sensor 130 may be a capacitive, resistive, optical, acoustic, or any other type of touch sensor technology capable of sensing touch. One of ordinary skill in the art will also recognize that the components or the stackup of touch screen 100 may vary based on an application or design.

Figure 2:
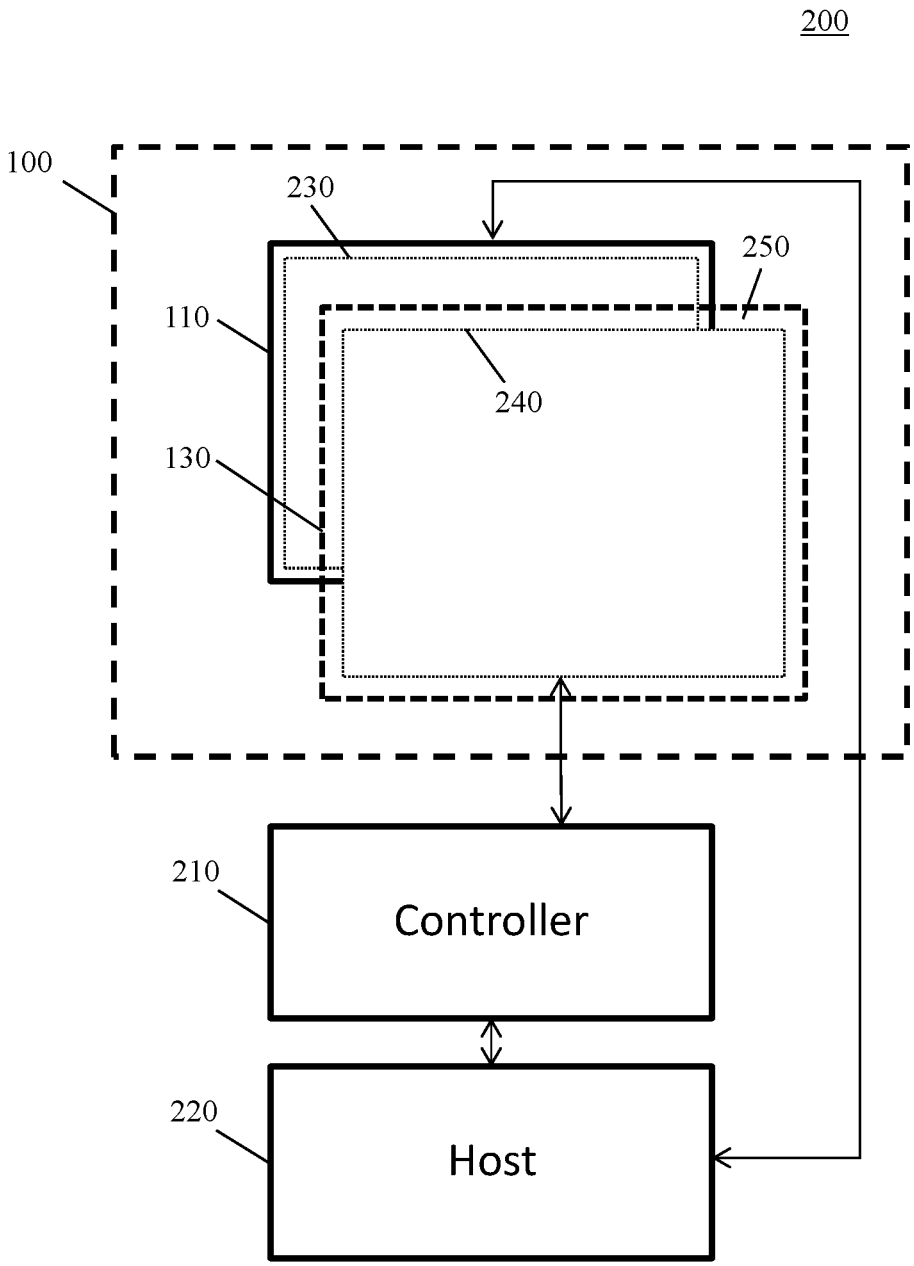
FIG. 2 shows a schematic view of a touch screen enabled system in accordance with one or more embodiments of the present invention.

FIG. 2 shows a schematic view of a touch screen enabled system 200 in accordance with one or more embodiments of the present invention. System 200 may be a consumer system, commercial system, or industrial system including, but not limited to, a smartphone, tablet computer, laptop computer, desktop computer, printer, monitor, television, appliance, kiosk, automatic teller machine, copier, desktop phone, automotive display system, portable gaming device, gaming console, or other application or design suitable for use with touch screen 100.

System 200 may include one or more printed circuit boards or flex circuits (not shown) on which one or more processors (not shown), system memory (not shown), and other system components (not shown) may be disposed. Each of the one or more processors may be a single-core processor (not shown) or a multi-core processor (not shown) capable of executing software instructions. Multi-core processors typically include a plurality of processor cores disposed on the same physical die (not shown) or a plurality of processor cores disposed on multiple die (not shown) disposed within the same mechanical package (not shown). System 200 may include one or more input/output devices (not shown), one or more local storage devices (not shown) including solid-state memory, a fixed disk drive, a fixed disk drive array, or any other non-transitory computer readable medium, a network interface device (not shown), and/or one or more network storage devices (not shown) including a network-attached storage device and a cloud-based storage device.

In certain embodiments, touch screen 100 may include touch sensor 130 that overlays at least a portion of a viewable area 230 of display device 110. Touch sensor 130 may include a viewable area 240 that corresponds to that portion of the touch sensor 130 that overlays the light emitting pixels (not shown) of display device 110. Touch sensor 130 may include a bezel circuit 250 outside at least one side of the viewable area 240 that provides connectivity between touch sensor 130 and a controller 210. In other embodiments, touch sensor 130, or the function that it implements, may be integrated into display device 110 (not independently illustrated). Controller 210 electrically drives at least a portion of touch sensor 130. Touch sensor 130 senses touch (capacitance, resistance, optical, acoustic, or other technology) and conveys information corresponding to the sensed touch to controller 210.

The manner in which the sensing of touch is measured, tuned, and/or filtered may be configured by controller 210. In addition, controller 210 may recognize one or more gestures based on the sensed touch or touches. Controller 210 provides host 220 with touch or gesture information corresponding to the sensed touch or touches. Host 220 may use this touch or gesture information as user input and respond in an appropriate manner. In this way, the user may interact with system 200 by touch or gestures on touch screen 100. In certain embodiments, host 220 may be the one or more printed circuit boards or flex circuits (not shown) on which the one or more processors (not shown) are disposed. In other embodiments, host 220 may be a subsystem or any other part of system 200 that is configured to interface with display device 110 and controller 210. One of ordinary skill in the art will recognize that the components and configuration of the components of system 200 may vary based on an application or design in accordance with one or more embodiments of the present invention.

Figure 3:
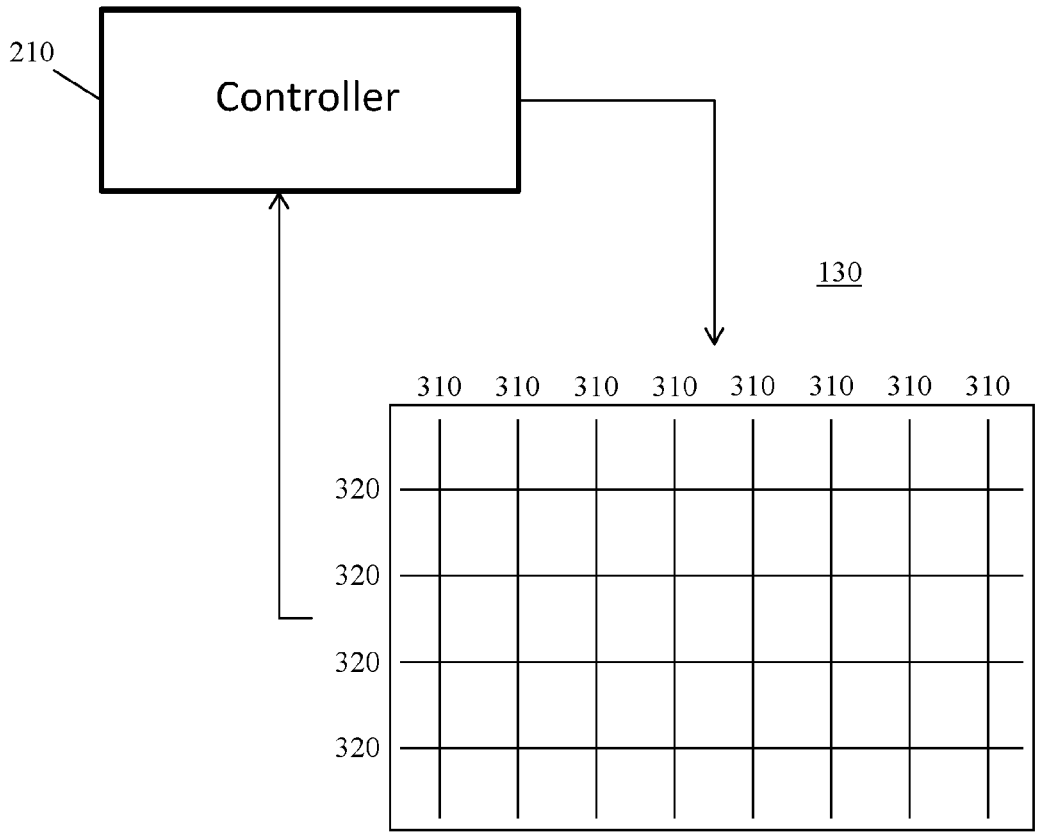
FIG. 3 shows a functional representation of a touch sensor as part of a touch screen in accordance with one or more embodiments of the present invention.

FIG. 3 shows a functional representation of a touch sensor 130 as part of a touch screen 100 in accordance with one or more embodiments of the present invention. In certain embodiments, touch sensor 130 may be viewed as a plurality of column channels 310 and a plurality of row channels 320 arranged as a mesh grid. The number of column channels 310 and the number of row channels 320 may not be the same and may vary based on an application or a design. The apparent intersections of column channels 310 and row channels 320 may be viewed as uniquely addressable locations of touch sensor 130. In operation, controller 210 may electrically drive one or more row channels 320 and touch sensor 130 may sense touch on one or more column channels 310 that are sampled by controller 210. One of ordinary skill in the art will recognize that the role of row channels 320 and column channels 310 may be reversed such that controller 210 electrically drives one or more column channels 310 and touch sensor 130 senses touch on one or more row channels 320 that are sampled by controller 210.

In certain embodiments, controller 210 may interface with touch sensor 130 by a scanning process. In such an embodiment, controller 210 may electrically drive a selected row channel 320 (or column channel 310) and sample all column channels 310 (or row channels 320) that intersect the selected row channel 320 (or the selected column channel 310) by sensing, for example, changes in capacitance at each intersection. This process may be continued through all row channels 320 (or all column channels 310) such that capacitance is measured at each uniquely addressable location of touch sensor 130 at predetermined intervals. Controller 210 may allow for the adjustment of the scan rate depending on the needs of a particular application or design. One of ordinary skill in the art will recognize that the scanning process discussed above may also be used with other touch sensor technologies in accordance with one or more embodiments of the present invention. In other embodiments, controller 210 may interface with touch sensor 130 by an interrupt driven process. In such an embodiment, a touch or a gesture generates an interrupt to controller 210 that triggers controller 210 to read one or more of its own registers that store sensed touch information sampled from touch sensor 130 at predetermined intervals. One of ordinary skill in the art will recognize that the mechanism by which touch or gestures are sensed by touch sensor 130 and sampled by controller 210 may vary based on an application or a design in accordance with one or more embodiments of the present invention.

Figure 4:
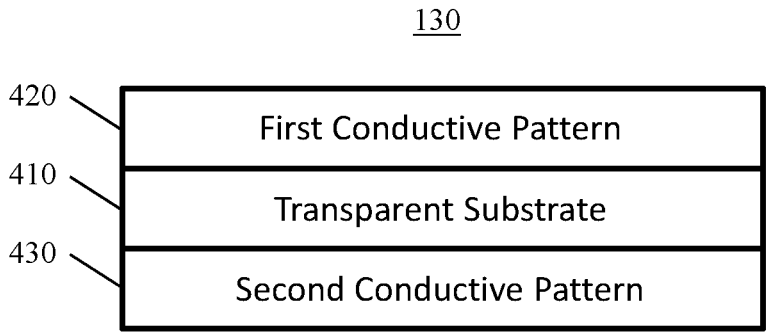
FIG. 4 shows a cross-section of a touch sensor with conductive patterns disposed on opposing sides of a transparent substrate in accordance with one or more embodiments of the present invention.

FIG. 4 shows a cross-section of a touch sensor 130 with conductive patterns 420 and 430 disposed on opposing sides of a transparent substrate 410 in accordance with one or more embodiments of the present invention. In certain embodiments, touch sensor 130 may include a first conductive pattern 420 disposed on a top, or user-facing, side of a transparent substrate 410 and a second conductive pattern 430 disposed on a bottom side of the transparent substrate 410. The first conductive pattern 420 may overlay the second conductive pattern 430 at a predetermined alignment that may include an offset. One of ordinary skill in the art will recognize that a conductive pattern may be any shape or pattern of one or more conductors (not shown) in accordance with one or more embodiments of the present invention. One of ordinary skill in the art will also recognize that any type of touch sensor 130 conductor, including, for example, metal conductors, metal mesh conductors, indium tin oxide ("ITO") conductors, poly(3,4-ethylenedioxythiophene ("PEDOT") conductors, carbon nanotube conductors, silver nanowire conductors, or any other touch sensor 130 conductors may be used in accordance with one or more embodiments of the present invention.

One of ordinary skill in the art will recognize that other touch sensor 130 stackups (not shown) may be used in accordance with one or more embodiments of the present invention. For example, single-sided touch sensor 130 stackups may include conductors disposed on a single side of a substrate 410 where conductors that cross are isolated from one another by a dielectric material (not shown), such as, for example, as used in On Glass Solution ("OGS") touch sensor 130 embodiments. Double-sided touch sensor 130 stackups may include conductors disposed on opposing sides of the same substrate 140 (as shown in FIG. 4) or bonded touch sensor 130 embodiments (not shown) where conductors are disposed on at least two different sides of at least two different substrates 410. Bonded touch sensor 130 stackups may include, for example, two single-sided substrates 410 bonded together (not shown), one double-sided substrate 410 bonded to a single-sided substrate 410 (not shown), or a double-sided substrate 410 bonded to another double-sided substrate 410 (not shown). One of ordinary skill in the art will recognize that other touch sensor 130 stackups, including those that vary in the number, the type, the organization, and/or the configuration of substrate(s) and/or conductive pattern(s) are within the scope of one or more embodiments of the present invention. One of ordinary skill in the art will also recognize that one or more of the above-noted touch sensor 130 stackups may be used in applications where touch sensor 130 is integrated into display device 110.

With respect to transparent substrate 410, transparent means capable of transmitting a substantial portion of visible light through the substrate suitable for a given touch sensor application or design. In certain embodiments, transparent substrate 410 may be polyethylene terephthalate ("PET"), polyethylene naphthalate ("PEN"), cellulose acetate ("TAC"), cycloaliphatic hydrocarbons ("COP"), polymethylmethacrylates ("PMMA"), polyimide ("PI"), bi-axially-oriented polypropylene ("BOPP"), polyester, polycarbonate, glass, copolymers, blends, or combinations thereof. In other embodiments, transparent substrate 410 may be any other transparent material suitable for use as a touch sensor substrate. One of ordinary skill in the art will recognize that the composition of transparent substrate 410 may vary based on an application or design in accordance with one or more embodiments of the present invention.

Figure 5:
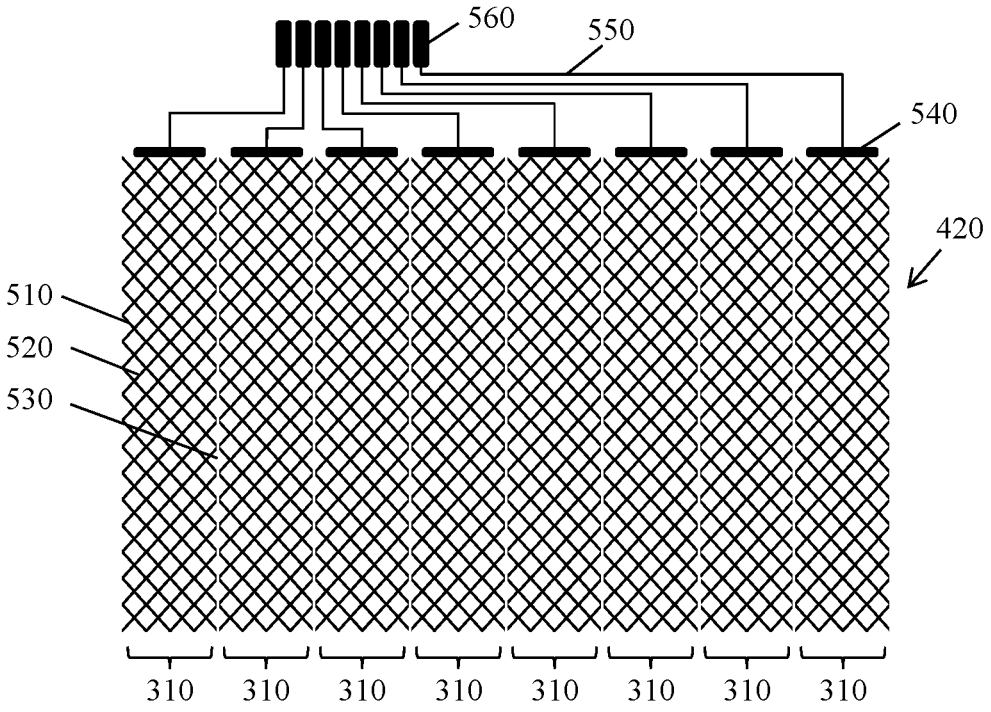
FIG. 5 shows a first conductive pattern disposed on a transparent substrate in accordance with one or more embodiments of the present invention.

FIG. 5 shows a first conductive pattern 420 disposed on a transparent substrate (e.g., transparent substrate 410) in accordance with one or more embodiments of the present invention. In certain embodiments, first conductive pattern 420 may include a mesh formed by a plurality of parallel conductive lines oriented in a first direction 510 and a plurality of parallel conductive lines oriented in a second direction 520 that are disposed on a side of a transparent substrate (e.g., transparent substrate 410). One of ordinary skill in the art will recognize that the number of parallel conductive lines oriented in the first direction 510 and/or the number of parallel conductive lines oriented in the second direction 520 may vary based on an application or design. One of ordinary skill in the art will also recognize that a size of first conductive pattern 420 may vary based on an application or a design. In other embodiments, first conductive pattern 420 may include any other shape or pattern formed by one or more conductive lines or features (not independently illustrated). One of ordinary skill in the art will recognize that a conductive pattern is not limited to parallel conductive lines and could be any one or more of predetermined orientations of line segments, random orientations of line segments, curved line segments, conductive particles, polygons, or any other shape(s) or pattern(s) comprised of electrically conductive material (not independently illustrated) in accordance with one or more embodiments of the present invention.

In certain embodiments, the plurality of parallel conductive lines oriented in the first direction 510 may be perpendicular to the plurality of parallel conductive lines oriented in the second direction 520, thereby forming the mesh. In other embodiments, the plurality of parallel conductive lines oriented in the first direction 510 may be angled relative to the plurality of parallel conductive lines oriented in the second direction 520, thereby forming the mesh. One of ordinary skill in the art will recognize that the relative angle between the plurality of parallel conductive lines oriented in the first direction 510 and the plurality of parallel conductive lines oriented in the second direction 520 may vary based on an application or a design in accordance with one or more embodiments of the present invention.

In certain embodiments, a plurality of channel breaks 530 may partition first conductive pattern 420 into a plurality of column channels 310, each electrically isolated from the others. One of ordinary skill in the art will recognize that the number of channel breaks 530 and/or the number of column channels 310 may vary based on an application or design in accordance with one or more embodiments of the present invention. Each column channel 310 may route to a channel pad 540. Each channel pad 540 may route to an interface connector 560 by way of one or more interconnect conductive lines 550. Interface connectors 560 may provide a connection interface between a touch sensor (e.g., 130 of FIG. 1) and a controller (e.g., 210 of FIG. 2).

Figure 6:
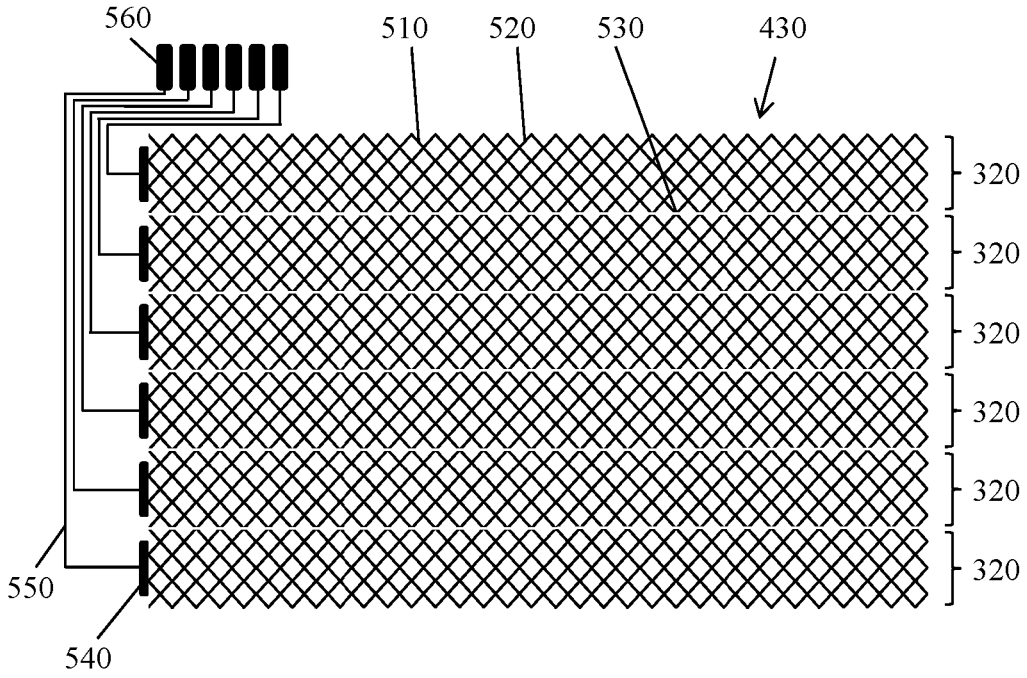
FIG. 6 shows a second conductive pattern disposed on a transparent substrate in accordance with one or more embodiments of the present invention.

FIG. 6 shows a second conductive pattern 430 disposed on a transparent substrate (e.g., transparent substrate 410) in accordance with one or more embodiments of the present invention. In certain embodiments, second conductive pattern 430 may include a mesh formed by a plurality of parallel conductive lines oriented in a first direction 510 and a plurality of parallel conductive lines oriented in a second direction 520 that are disposed on a side of a transparent substrate (e.g., transparent substrate 410). One of ordinary skill in the art will recognize that the number of parallel conductive lines oriented in the first direction 510 and/or the number of parallel conductive lines oriented in the second direction 520 may vary based on an application or design.

The second conductive pattern 430 may be substantially similar in size to the first conductive pattern 420. One of ordinary skill in the art will recognize that a size of the second conductive pattern 430 may vary based on an application or a design. In other embodiments, second conductive pattern 430 may include any other shape or pattern formed by one or more conductive lines or features (not independently illustrated). One of ordinary skill in the art will recognize that a conductive pattern is not limited to parallel conductive lines and could be any one or more of predetermined orientations of line segments, random orientations of line segments, curved line segments, conductive particles, polygons, or any other shape(s) or pattern(s) comprised of electrically conductive material (not independently illustrated) in accordance with one or more embodiments of the present invention.

In certain embodiments, the plurality of parallel conductive lines oriented in the first direction 510 may be perpendicular to the plurality of parallel conductive lines oriented in the second direction 520, thereby forming the mesh. In other embodiments, the plurality of parallel conductive lines oriented in the first direction 510 may be angled relative to the plurality of parallel conductive lines oriented in the second direction 520, thereby forming the mesh. One of ordinary skill in the art will recognize that the relative angle between the plurality of parallel conductive lines oriented in the first direction 510 and the plurality of parallel conductive lines oriented in the second direction 520 may vary based on an application or a design in accordance with one or more embodiments of the present invention.

In certain embodiments, a plurality of channel breaks 530 may partition second conductive pattern 430 into a plurality of row channels 320, each electrically isolated from the others. One of ordinary skill in the art will recognize that the number of channel breaks 530 and/or the number of row channels 320 may vary based on an application or design in accordance with one or more embodiments of the present invention. Each row channel 320 may route to a channel pad 540. Each channel pad 540 may route to an interface connector 560 by way of one or more interconnect conductive lines 550. Interface connectors 560 may provide a connection interface between a touch sensor (e.g., 130 of FIG. 1) and a controller (e.g., 210 of FIG. 2).

Figure 7:
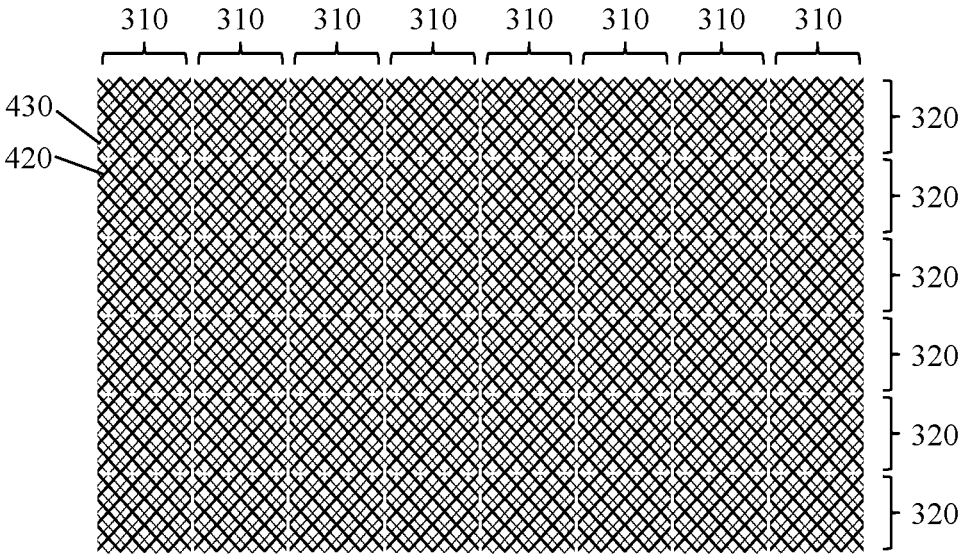
FIG. 7 shows a portion of a touch sensor in accordance with one or more embodiments of the present invention.

FIG. 7 shows a portion of a touch sensor (e.g., touch sensor 130) in accordance with one or more embodiments of the present invention. In certain embodiments, a touch sensor 130 may be formed, for example, by disposing a first conductive pattern 420 on a top, or user-facing, side of a transparent substrate (e.g., transparent substrate 410) and disposing a second conductive pattern 430 on a bottom side of the transparent substrate (e.g., transparent substrate 410). In other embodiments, a touch sensor 130 may be formed, for example, by disposing a first conductive pattern 420 on a side of a first transparent substrate (e.g., transparent substrate 410), disposing a second conductive pattern 430 on a side of a second transparent substrate (e.g., transparent substrate 410), and bonding the first transparent substrate to the second transparent substrate. One of ordinary skill in the art will recognize that the disposition of the conductive pattern or patterns may vary based on the touch sensor 130 stackup in accordance with one or more embodiments of the present invention. In embodiments that use two conductive patterns, the first conductive pattern 420 and the second conductive pattern 430 may be offset vertically, horizontally, and/or angularly relative to one another. One of ordinary skill in the art will recognize that the offset between the first conductive pattern 420 and the second conductive pattern 430 may vary based on an application or a design.

In certain embodiments, the first conductive pattern 420 may include a plurality of parallel conductive lines oriented in a first direction (e.g., 510 of FIG. 5) and a plurality of parallel conductive lines oriented in a second direction (e.g., 520 of FIG. 5) that form a mesh that is partitioned by a plurality of breaks (e.g., 530 of FIG. 5) into electrically partitioned column channels 310. In certain embodiments, the second conductive pattern 430 may include a plurality of parallel conductive lines oriented in a first direction (e.g., 510 of FIG. 6) and a plurality of parallel conductive lines oriented in a second direction (e.g., 520 of FIG. 6) that form a mesh that is partitioned by a plurality of breaks (e.g., 530 of FIG. 6) into electrically partitioned row channels 320. In operation, a controller (e.g., 210 of FIG. 2) may electrically drive one or more row channels 320 (or column channels 310) and touch sensor 130 senses touch on one or more column channels 310 (or row channels 320) sampled by the controller (210 of FIG. 2). In other embodiments, the disposition and/or the role of the first conductive pattern 420 and the second conductive pattern 430 may be reversed.

In certain embodiments, one or more of the plurality of parallel conductive lines oriented in a first direction (e.g., 510 of FIG. 5 or FIG. 6), one or more of the plurality of parallel conductive lines oriented in a second direction (e.g., 520 of FIG. 5 or FIG. 6), one or more of the plurality of breaks (e.g., 530 of FIG. 5 or FIG. 6), one or more of the plurality of channel pads (e.g., 540 of FIG. 5 or FIG. 6), one or more of the plurality of interconnect conductive lines (e.g., 550 of FIG. 5 or FIG. 6), and/or one or more of the plurality of interface connectors (e.g., 560 of FIG. 5 or FIG. 6) of the first conductive pattern 420 or second conductive pattern 430 may have different line widths and/or different orientations. Each may vary in line width and/or orientation. In addition, the number of parallel conductive lines oriented in the first direction (e.g., 510 of FIG. 5 or FIG. 6), the number of parallel conductive lines oriented in the second direction (e.g., 520 of FIG. 5 or FIG. 6), and the line-to-line spacing between them may vary based on an application or a design. One of ordinary skill in the art will recognize that the size, configuration, and design of each conductive pattern may vary based on an application or a design in accordance with one or more embodiments of the present invention.

In certain embodiments, one or more of the plurality of parallel conductive lines oriented in the first direction (e.g., 510 of FIG. 5 or FIG. 6) and one or more of the plurality of parallel conductive lines oriented in the second direction (e.g., 520 of FIG. 5 or FIG. 6) may have a line width that varies based on an application or design, including, for example, micrometer-fine line widths.

In certain embodiments, one or more of the plurality of channel pads (e.g., 540 of FIG. 5 or FIG. 6), one or more of the plurality of interconnect conductive lines (e.g., 550 of FIG. 5 or FIG. 6), and/or one or more of the plurality of interface connectors (e.g., 560 of FIG. 5 or FIG. 6) may have a different width or orientation. In addition, the number of channel pads (e.g., 540 of FIG. 5 or FIG. 6), interconnect conductive lines (e.g., 550 of FIG. 5 or FIG. 6), and/or interface connectors (e.g., 560 of FIG. 5 or FIG. 6) and the line-to-line spacing between them may vary based on an application or a design. One of ordinary skill in the art will recognize that the size, configuration, and design of each channel pad (e.g., 540 of FIG. 5 or FIG. 6), interconnect conductive line (e.g., 550 of FIG. 5 or FIG. 6), and/or interface connector (e.g., 560 of FIG. 5 or FIG. 6) may vary based on an application or a design in accordance with one or more embodiments of the present invention.

In typical applications, each of the one or more channel pads (e.g., 540 of FIG. 5 and FIG. 6), interconnect conductive lines (e.g., 550 of FIG. 5 and FIG. 6), and/or interface connectors (e.g., 560 of FIG. 5 and FIG. 6) have a width substantially larger than each of the plurality of parallel conductive lines oriented in a first direction (e.g., 510 of FIG. 5 or FIG. 6) or each of the plurality of parallel conductive lines oriented in a second direction (e.g., 520 of FIG. 5 or FIG. 6). One of ordinary skill in the art will recognize that the size, configuration, and design as well as the number, shape, and width of channel pads (e.g., 540 of FIG. 5 or FIG. 6), interconnect conductive lines (e.g., 550 of FIG. 5 or FIG. 6), and/or interface connectors (e.g., 560 of FIG. 5 or FIG. 6) may vary based on an application or a design in accordance with one or more embodiments of the present invention.

Figure 8:
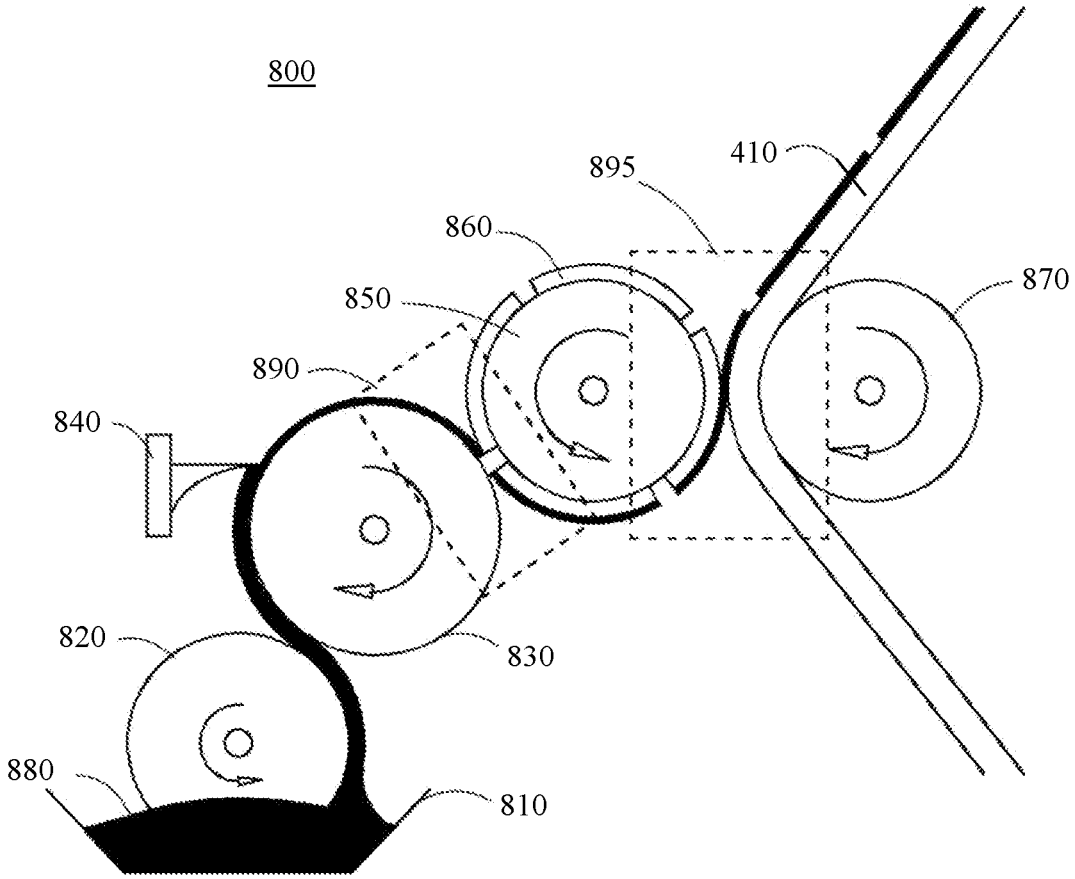
FIG. 8 shows a flexographic printing station in accordance with one or more embodiments of the present invention.

FIG. 8 shows a flexographic printing station 800 in accordance with one or more embodiments of the present invention. Flexographic printing station 800 may include an ink pan 810, an ink roll 820 (also referred to as a fountain roll), an anilox roll 830 (also referred to as a meter roll), a doctor blade 840, a printing plate cylinder 850, a flexographic printing plate 860, and an impression cylinder 870 configured to print on a transparent substrate 410 material that moves through the station 800.

In operation, ink roll 820 rotates transferring ink 880 from ink pan 810 to anilox roll 830. Anilox roll 830 may be constructed of a rigid cylinder that includes a curved contact surface about the body of the cylinder that contains a plurality of dimples, also referred to as cells (not shown), that hold and transfer ink 880. As anilox roll 830 rotates, doctor blade 840 may be used to remove excess ink 880 from anilox roll 830. In transfer area 890, anilox roll 830 rotates transferring ink 880 from some of the cells to flexographic printing plate 860. Flexographic printing plate 860 may include a contact surface formed by distal ends of an image formed in flexographic printing plate 860. The distal ends of the image are inked to transfer an image to transparent substrate 410. The cells may meter the amount of ink 880 transferred to flexographic printing plate 860 to a near uniform volume. In certain embodiments, ink 880 may be a precursor, or catalytic, ink that serves as a plating or buildup seed suitable for metallization by electroless plating or other buildup processes. For example, ink 880 may be a catalytic ink that comprises one or more of silver, nickel, copper, palladium, cobalt, platinum group metals, alloys thereof, or other catalytic particles. In other embodiments, ink 880 may be a conductive ink suitable for direct printing of conductive lines or features on transparent substrate 410. In still other embodiments, ink 880 may be a non-catalytic and non-conductive ink. One of ordinary skill in the art will recognize that the composition of ink 880 may vary based on an application or a design.

Printing plate cylinder 850 may be constructed of a rigid cylinder composed of a metal, such as, for example, steel. Flexographic printing plate 860 may be mounted to a curved contact surface about the body of printing plate cylinder 850 by an adhesive (not shown). Transparent substrate 410 material moves between counter rotating flexographic printing plate 860 and impression cylinder 870. Impression cylinder 870 may be constructed of a rigid cylinder composed of a metal that may be coated with an abrasion resistant coating. As impression cylinder 870 rotates, it applies pressure between transparent substrate 410 material and flexographic printing plate 860, transferring an ink 880 image from flexographic printing plate 860 onto transparent substrate 410 at transfer area 895. The rotational speed of printing plate cylinder 850 may be synchronized to match the speed at which transparent substrate 410 material moves through flexographic printing system 800. The speed may vary between 20 feet per minute to 3000 feet per minute.

In certain embodiments, one or more flexographic printing stations 800 may be used to print a precursor, or catalytic, ink 880 image (not shown) of one or more conductive patterns (e.g., first conductive pattern 420 or second conductive pattern 430) on one or more sides of one or more transparent substrates 410. Subsequent to flexographic printing, the precursor, or catalytic, ink 880 image (not shown) may be metallized by one or more of an electroless plating process, an immersion bathing process, and/or other buildup processes, forming one or more conductive patterns (e.g., first conductive pattern 420 or second conductive pattern 430) on one or more sides of one or more transparent substrates 410. In other embodiments, one or more flexographic printing stations 800 may be used to directly print a conductive ink 880 image (not shown) of one or more conductive patterns (e.g., first conductive pattern 420 or second conductive pattern 430) on one or more sides of one or more transparent substrates 410.

Figure 9:
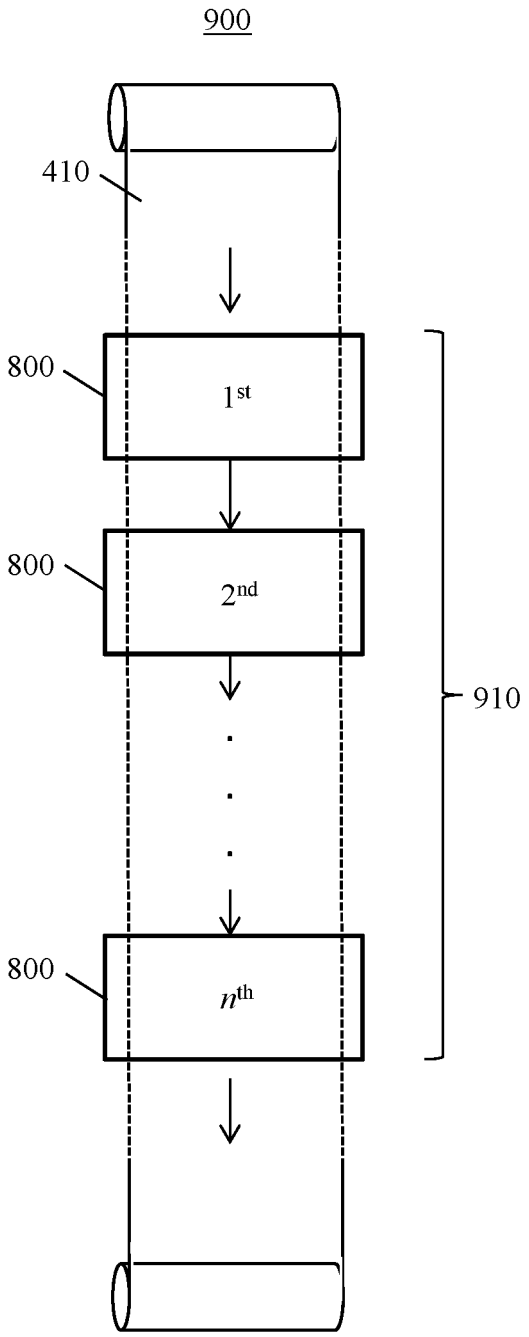
FIG. 9 shows a multi-station flexographic printing system in accordance with one or more embodiments of the present invention.

FIG. 9 shows a multi-station flexographic printing system 900 in accordance with one or more embodiments of the present invention. In certain embodiments, a multi-station flexographic printing system 900 may include a plurality 910 of flexographic printing stations 800 that are configured to print on one or more sides of a transparent substrate 410 in sequential order. In applications where the multi-station flexographic printing system 900 is configured to print on opposing sides of the same transparent substrate, one or more of the plurality of flexographic printing stations 800 may be configured to print on a first side of transparent substrate 410 and one or more of the plurality of flexographic printing stations 800 may be configured to print on a second side of transparent substrate 410. In other embodiments, a multi-station flexographic printing system 900 may include a plurality 910 of flexographic printing stations 800 where only a subset of the plurality 910 of flexographic printing stations 800 are configured to print on one or more sides of a transparent substrate 410 in sequential order. One of ordinary skill in the art will recognize that the configuration of multi-station flexographic printing system 900 may vary based on an application or design in accordance with one or more embodiments of the present invention.

Multi-station flexographic printing system 900 may include a number, n, of flexographic printing stations 800 where the number varies based on an application or design. In certain embodiments, a first flexographic printing station ($1^{st}$ 800 of FIG. 9) may be used to print a non-catalytic ink (880 of FIG. 8) image on substrate, in an area outside a designated image area, of, for example, one or more bearer bars (not shown) and/or one or more optical registration marks (not shown) that may be used to control the press during flexographic printing operations. The number, n−1, of subsequent flexographic printing stations ($2^{nd}$ through $n^{th}$ 800 of FIG. 9) may vary based on an application or design. In certain embodiments, the number of subsequent flexographic printing stations 800 may include at least one flexographic printing station 800 for each side of transparent substrate 410 to be printed. In other embodiments, the number of subsequent flexographic printing stations 800 may include a plurality of flexographic printing stations 800 for each side of transparent substrate 410 to be printed. In still other embodiments, the number of subsequent flexographic printing stations 800 may include a plurality of flexographic printing stations 800 for each side of transparent substrate 410 to be printed, where the number of flexographic printing stations 800 for a given side may be determined by the number of micrometer-fine lines or features to be printed having a different width or orientation.

For example, in certain touch sensor embodiments, multi-station flexographic printing system 900 may be configured to print an image of a first conductive pattern (e.g., first conductive pattern 420) on a first side of transparent substrate 410 and an image of a second conductive pattern (e.g., second conductive pattern 430) on a second side of transparent substrate 410. The image of the first conductive pattern may include an image of a plurality of parallel conductive lines oriented in a first direction (e.g., 510 of FIG. 5), an image of a plurality of parallel conductive lines oriented in a second direction (e.g., 520 of FIG. 5), and an image of bezel circuitry (e.g., 540, 550, and 560 of FIG. 5). The image of the second conductive pattern may include an image of a plurality of parallel conductive lines oriented in a first direction (e.g., 510 of FIG. 6), an image of a plurality of parallel conductive lines oriented in a second direction (e.g., 520 of FIG. 6), and an image of bezel circuitry (e.g., 540, 550, and 560 of FIG. 6).

Continuing with the example, a first flexographic printing station ($1^{st}$ 800 of FIG. 9) may be configured to print a non-catalytic ink (880 of FIG. 8) image on a first side of transparent substrate 410, a second flexographic printing station ($2^{nd}$ 800 of FIG. 9), a third flexographic printing station ($3^{rd}$ 800 of FIG. 9), and a fourth flexographic printing station ($4^{th}$ 800 of FIG. 9) may be configured to print a catalytic ink (880 of FIG. 8) image of a first conductive pattern (e.g., first conductive pattern 420) on the first side of transparent substrate 410, and a fifth flexographic printing station ($5^{th}$ 800 of FIG. 9), a sixth flexographic printing station ($6^{th}$ 800 of FIG. 9), and a seventh flexographic printing station ($7^{th}$ 800 of FIG. 9) may be configured to print a catalytic ink (880 of FIG. 8) image of a second conductive pattern (e.g., second conductive pattern 430) on a second side of transparent substrate 410. One of ordinary skill in the art will recognize that the number and configuration of flexographic printing stations 800 of a multi-station flexographic printing system 900 may vary based on an application or design in accordance with one or more embodiments of the present invention.

Figure 10A:
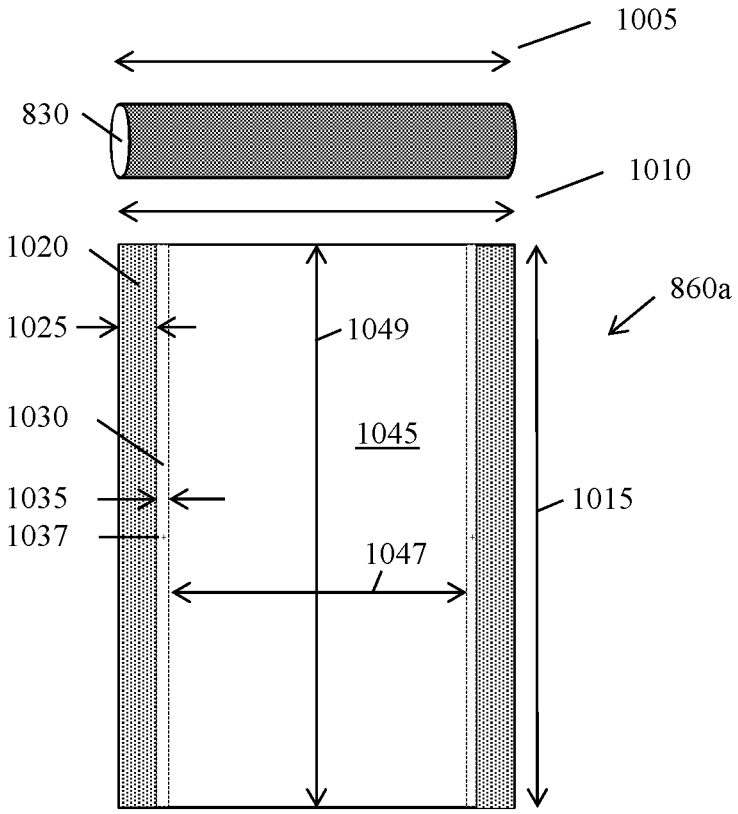
FIG. 10A shows an anilox roll and a flexographic printing plate for a first flexographic printing station in accordance with one or more embodiments of the present invention.

FIG. 10A shows an anilox roll 830 and a flexographic printing plate 860*a* for a first flexographic printing station (e.g., $1^{st}$ 800 of FIG. 9) of a multi-station flexographic printing system (e.g., 900 of FIG. 9) in accordance with one or more embodiments of the present invention. One of ordinary skill in the art will recognize that FIG. 10A shows flexographic printing plate 860*a* flattened out prior to, for example, mounting to a printing plate cylinder (e.g., 850 of FIG. 8) for purposes of illustration only. One of ordinary skill in the art will also recognize that other types of flexographic printing plates (not shown), composed of different materials, manufactured using different processes, and/or having different structure, may be used in accordance with one or more embodiments of the present invention. Anilox roll 830 includes a rigid cylinder (not independently illustrated) that includes a plurality of cells (not independently illustrated) disposed on, or formed in, a curved contact surface (not independently illustrated) of the cylinder. The plurality of cells are configured to transfer ink (880 of FIG. 8) to portions of flexographic printing plate 860*a* configured to be inked during flexographic printing operations. In turn, flexographic printing plate 860*a* prints an ink image (not shown) on a substrate (e.g., 410 of FIG. 9).

In certain embodiments, flexographic printing plate 860*a* may have a width 1010 and a length 1015 that may vary based on an application or design. As such, the first flexographic printing station of the multi-station flexographic printing system may include an anilox roll 830 having a size, including, for example, a width 1005, suitable for transferring ink to flexographic printing plate 860*a* during flexographic printing operations.

In certain embodiments, one or more bearer bars 1020 may be formed in flexographic printing plate 860*a*. The one or more bearer bars 1020 may be substantially rectangular in shape and may be formed along the lengthwise 1015 edge or edges of flexographic printing plate 860*a*. The one or more bearer bars 1020 may include a patterned printing surface (not independently illustrated) that provides substantially continuous contact between anilox roll 830 and flexographic printing plate 860*a* to reduce or eliminate bounce during flexographic printing operations. Bounce may occur when, for example, flexographic printing plate 860*a* includes portions that are free of any printing surface that are not intended to be inked or printed on substrate and the lack of contact between the anilox roll 830 and the flexographic printing plate 860*a* causes one or more of the anilox roll 830 and/or the flexographic printing plate 860*a* to bounce when they come back into contact, giving rise to non-uniform ink transfer and potentially unintended printed bands on substrate. Each of the one or more bearer bars 1020 may have a width 1025 providing sufficient continuous contact to prevent banding that may vary based on an application or design. By reducing or eliminating bounce, anilox roll 830 may transfer ink or other material to flexographic printing plate 860*a* in a more uniform manner, which is very important when printing micrometer-fine lines or features on substrate. One of ordinary skill in the art will recognize that the number and/or the shape of the one or more bearer bars 1020 may vary based on an application or design in accordance with one or more embodiments of the present invention. In certain touch sensor embodiments, the one or more bearer bars 1020 are printed on substrate with inexpensive non-catalytic ink that is not metallized during a metallization process that may occur subsequent to flexographic printing operations.

In certain embodiments, one or more optical registration tracks 1030 may be allocated space on flexographic printing plate 860*a*. The allocated space for the one or more optical registration tracks 1030 may be substantially rectangular in shape, adjacent to the one or more bearer bars 1020, and may span a length 1015 of flexographic printing plate 860*a*. However, the relative location and order of the one or more bearer bars 1020 and the one or more optical registration tracks 1030 may vary based on an application or design in accordance with one or more embodiments of the present invention. While the one or more optical registration tracks 1030 are substantially clear and free of any printing surface, an optical registration mark 1037 may be disposed within the one or more optical registration tracks 1030 for detection by an optical sensor system (not shown). The location of the optical registration mark 1037 on flexographic printing plate 860*a* may vary based on the setup and configuration of the printing press. In addition, the location of the optical registration mark 1037 on flexographic printing plate 860*a* may be adjusted to maintain print quality in a manner that may vary based on an application or design A press control system (not shown) may use the optical sensor system and the optical registration mark 1037 to determine the rotational position of the printing plate cylinder (e.g., printing plate cylinder 850) during each revolution of the printing plate cylinder during flexographic printing operations. Each of the one or more optical registration tracks 1030 may have a width 1035 sufficient to dispose an optical registration mark 1037 capable of being sensed by the optical sensor system that may vary based on an application or design.

A reserved image area 1045 of flexographic printing plate 860*a*, in between the one or more optical registration tracks 1030 (or in between the one or more bearer bars 1020 in other embodiments not depicted), may be unpatterned and free of any printing surface. As such, the corresponding area on substrate (e.g., 410 of FIG. 9) may be reserved for an image to be printed by one or more subsequent flexographic printing stations (e.g., $2^{nd}$ through $n^{th}$ 800 of FIG. 9). The reserved image area 1045 may be bounded by a width 1047 and a length 1049. The length 1049 of the reserved image area 1045 may be smaller than the length 1015 of flexographic printing plate 860*a* so as to avoid printing near the edges of flexographic printing plate 860*a*. As such, the area of the reserved image area 1045 may be constrained by the width 1025 of the one or more bearer bars 1020, the width 1035 of the one or more optical registration tracks 1030, and the length 1015 of flexographic printing plate 860*a*.

Figure 10B:
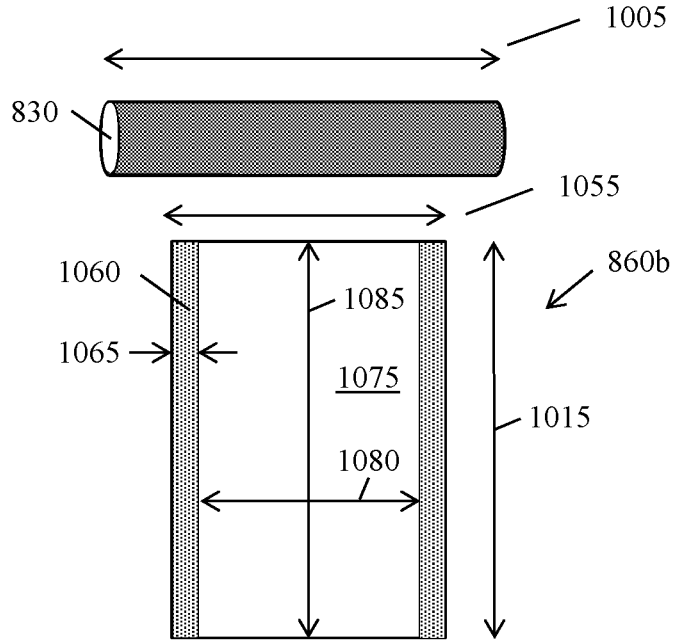
FIG. 10B shows an anilox roll and a flexographic printing plate for a subsequent flexographic printing station in accordance with one or more embodiments of the present invention.

Continuing in FIG. 10B, an anilox roll 830 and a flexographic printing plate 860*b* for a subsequent flexographic printing station are shown in accordance with one or more embodiments of the present invention. One of ordinary skill in the art will recognize that anilox roll 830 and flexographic printing plate 860*b* may be representative of any subsequent flexographic printing station of the multi-station flexographic printing system with the caveat that a pattern (not shown) disposed in the image area 1075 may vary from station to station. One of ordinary skill in the art will also recognize that FIG. 10B shows flexographic printing plate 860*b* flattened out prior to, for example, mounting to a printing plate cylinder (e.g., 850 of FIG. 8) for purposes of illustration only. One of ordinary skill in the art will also recognize that other types of flexographic printing plates (not shown), composed of different materials, manufactured using different processes, and/or having different structure, may be used in accordance with one or more embodiments of the present invention.

In certain embodiments, the multi-station flexographic printing system may use one or more subsequent flexographic printing stations to flexographically print a catalytic ink (e.g., 880 of FIG. 8) image of one or more conductive patterns (e.g., first conductive pattern 420 or second conductive pattern 430) on one or more sides of the substrate. Catalytic ink is substantially more expensive than non-catalytic ink and may be used to print the image on substrate. Subsequent to flexographic printing, the printed catalytic ink may be metallized by a metallization process (not shown), including, for example, electroless plating and/or immersion bathing. As such, it is desirable to minimize the use of expensive catalytic ink for areas that are not intended to be conductive post metallization.

In certain embodiments, one or more bearer bars 1060 may be formed in flexographic printing plate 860*b*. The one or more bearer bars 1060 may be substantially rectangular in shape and may be formed along the lengthwise 1015 edge or edges of flexographic printing plate 860*b*. The one or more bearer bars 1060 may include a patterned printing surface (not independently illustrated) that provides substantially continuous contact between anilox roll 830 and flexographic printing plate 860*b* to reduce or eliminate bounce during flexographic printing operations. Bounce may occur when, for example, flexographic printing plate 860*b* includes portions that are free of any printing surface that are not intended to be inked or printed on substrate and the lack of contact between the anilox roll 830 and the flexographic printing plate 860*a* causes one or more of the anilox roll 830 and/or the flexographic printing plate 860*a* to bounce when they come back into contact, potentially giving rise to non-uniform ink transfer and unintended printed bands on substrate. Each of the one or more bearer bars 1060 may have a width 1065 providing sufficient continuous contact to prevent banding that may vary based on an application or design. One of ordinary skill in the art will also recognize that the number and/or the shape of the one or more bearer bars 1060 may vary based on an application or design in accordance with one or more embodiments of the present invention.

In certain embodiments, one or more bearer bars are required for each flexographic printing plate of each flexographic printing station of the multi-station flexographic printing system. Because the one or more bearer bars (1020 of FIG. 10A) of the first flexographic printing plate 860*a* are configured to print with a non-catalytic ink and the one or more optical registration tracks (1030 of FIG. 10A) cannot be overprinted, the one or more bearer bars 1060 of the subsequent flexographic printing stations, which are configured to print with expensive catalytic ink, are disposed on the flexographic printing plate 860*b* such that they are inside an area corresponding to the one or more bearer bars (1020 of FIG. 10A) and the one or more optical registration tracks (1030 of FIG. 10A) of the first flexographic printing plate (860*a* of FIG. 10A).

As such, a width 1055 of flexographic printing plate 860*b* may be smaller than the width (e.g., 1010 of FIG. 10A) of the flexographic printing plate (e.g., 860*a* of FIG. 10A) of the first flexographic printing station. For example, a width 1055 of flexographic printing plate 860*b* may be reduced to a width substantially equal to the width (e.g., 1047 of FIG. 10A) of the reserved image area (e.g., 1045 of FIG. 10A) of the flexographic printing plate (e.g., 860*a* of FIG. 10A) of the first flexographic printing station. By reducing the width 1055, an ink transfer area (not independently illustrated) of flexographic printing plate 860*b* of a subsequent flexographic printing station is reduced and constrained to an area within the one or more bearer bars (e.g., 1020 of FIG. 10A) and one or more optical registration tracks (e.g., 1030 of FIG. 10A) of the flexographic printing plate (e.g., 860*a* of FIG. 10A) of the first flexographic printing station.

Thus, flexographic printing plate 860*b* may include an image printing area 1075 that may be bounded by the edges of flexographic printing plate 860*b* lengthwise and the one or more bearer bars 1060 widthwise. While no image is shown, one of ordinary skill in the art will recognize that this is the printing surface where an image may be formed for printing on substrate. One of ordinary skill in the art will also recognize that the image may vary from station to station. The image printing area 1075 may have a width 1080 that may be equal to the width 1055 of the flexographic printing plate less the width of the one or more bearer bars 1060. The image printing area 1075 may have a length 1085 that may be substantially equal to the length 1015 of flexographic printing plate 860. However, the length 1085 of the image printing area 1075 may be smaller than the length 1015 of flexographic printing plate 860*b* so as to avoid printing near the edges of flexographic printing plate 860*b*.

However, it is important to note that the image printing area 1075 of the subsequent flexographic printing stations may be smaller than the reserved image area (e.g., 1045 of FIG. 10A) of the first flexographic printing station. Thus, the corresponding printable space on substrate is also reduced which may negatively affect the size of an application or design or yield. As such, more substrate and/or printing operations may be required to achieve the same design or yield. Another issue that arises is that each subsequent flexographic printing station prints bearer bars 1060 on substrate using expensive catalytic ink. Subsequent to flexographic printing, the printed bearer bars on substrate are subject to metallization that consumes expensive chemicals, including metals, in an area that does not require connectivity or conductivity from a functional perspective.

Accordingly, in one or more embodiments of the present invention, an anilox roll with a low surface energy zone provides the functional benefit of continuous contact of a conventional anilox roll, but does not print expensive catalytic ink on substrate in areas corresponding to the bearer bars. In addition, because the bearer bars of a flexographic printing plate of a subsequent flexographic printing station do not print expensive catalytic ink, the bearer bars may be disposed in the same area of the flexographic printing plate of a subsequent flexographic printing station as a flexographic printing plate of the first flexographic printing station, thereby allowing for a larger image printing area on substrate.

Figure 11A:
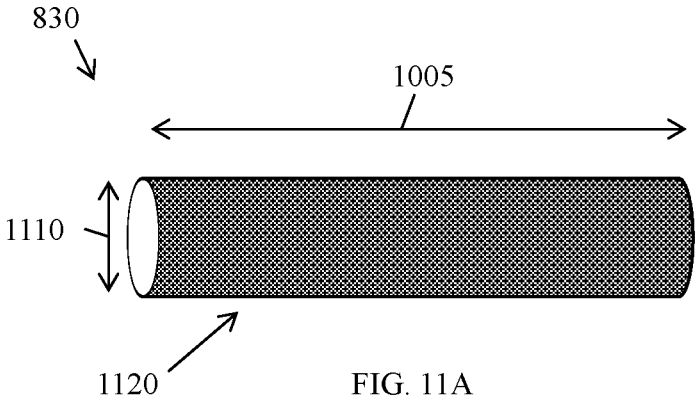
FIG. 11A shows an anilox roll for a first flexographic printing station in accordance with one or more embodiments of the present invention.

FIG. 11A shows an anilox roll 830 for a first flexographic printing station (e.g., 1$^{st}$ 800 of FIG. 9) in accordance with one or more embodiments of the present invention. Anilox roll 830 includes a rigid cylinder (not independently illustrated) constructed of steel, a carbon fiber composite, a carbon fiber composite covered with metal or chrome, or an aluminum core covered with metal, such as steel, or other material, or combinations thereof. One of ordinary skill in the art will recognize that the composition of the cylinder may vary in accordance with one or more embodiments of the present invention. The cylinder may have a length 1005 that varies based on an application or design. The cylinder may have a diameter 1110 that also varies based on an application or design. One or more roller mounts (not shown) may be disposed on the distal ends of the cylinder to secure and rotate anilox roll 830 as part of flexographic printing operations.

A plurality of cells may be formed on, or in, a curved contact surface 1120 of the cylinder. The curved contact surface 1120 is the surface around the body of the cylinder that spans the entire length 1005 of the cylinder. Each cell (not independently illustrated) is a small indentation of a predetermined geometry that holds and meters the amount of ink (e.g., 880 of FIG. 8) that is transferred to a flexographic printing plate (e.g., 860 of FIG. 10A) during flexographic printing operations. The plurality of cells extend around the body of the cylinder and span the entire length 1005 of the cylinder. In certain embodiments, a size and/or a shape of the predetermined geometry may be selected to meter a desired volume of ink for a given flexographic printing operation. The predetermined geometry may be hexagonal, elongated hexagons, tri-helical, pyramid, inverted pyramid, quadrangular, or any other shape or pattern. One of ordinary skill in the art will recognize that the size and/or the shape of the cells may vary in accordance with one or more embodiments of the present invention. The amount of ink held by a given cell may be measured in units of Billion Cubic Microns ("BCM"). In certain embodiments, each cell may hold approximately 0.3 BCM or less of ink. In other embodiments, each cell may hold approximately 0.5 BCM or less of ink. In still other embodiments, each cell may hold approximately 1 BCM or less of ink. In still other embodiments, each cell may hold greater than approximately 1 BCM of ink. One of ordinary skill in the art will recognize that the amount of ink held may vary based on an application or design in accordance with one or more embodiments of the present invention.

In certain embodiments, the curved contact surface 1120 of the cylinder may be polished smooth and a hard ceramic coating (not independently illustrated) may be deposited on the curved contact surface. After deposition, the hard ceramic coating may also be polished smooth. A plurality of cells (not independently illustrated) may be patterned into the hard ceramic coating, but do not extend into the cylinder itself.

In other embodiments, a first coating material (not shown) may be deposited over the curved contact surface 1120 of the cylinder forming a thin and smooth layer of first coating material. The deposited first coating eliminates the need to polish the surface of the cylinder smooth prior to deposition. The first coating material may be composed of chromium, copper, nickel, tungsten, titanium, molybdenum, other metals, or alloys thereof. The first coating material may be deposited by, for example, a chemical vapor deposition ("CVD") process, a plasma enhanced chemical vapor deposition ("PECVD") process, an atmospheric plasma enhanced chemical vapor deposition ("APCVD") process, or a physical vapor deposition ("PVD") process including sputtering and electron beam evaporation. The deposited first coating may have a thickness in a range between approximately 1 nanometer and several micrometers. A plurality of cells (not independently illustrated) may be patterned into the cylinder itself, through the first coating material. Because the patterned plurality of cells extend into the cylinder, stronger common walls are formed between adjacent cells. As a consequence, smaller cells capable of metering smaller volumes of ink may be used, the reliability, and the usable life of anilox roll 830 may be extended. Smaller volumes of ink are advantageous when printing micrometer-fine lines or features on substrate. A second coating material (not shown) may then be deposited over the patterned contact surface of the cylinder to protect the cells and/or enhance ink transfer. The second coating material may be composed of oxides, nitrides, borides, and carbides of metals including, but not limited to, aluminum, cerium, zirconium, hafnium, titanium, tungsten, molybdenum, and intermetallic compounds. The second coating material may be deposited by, for example, a CVD process, a PECVD process, an APCVD process, or a PVD process including sputtering and electron beam evaporation. The deposited second coating may have a thickness in a range between approximately 1 nanometer and several micrometers.

Figure 11B:
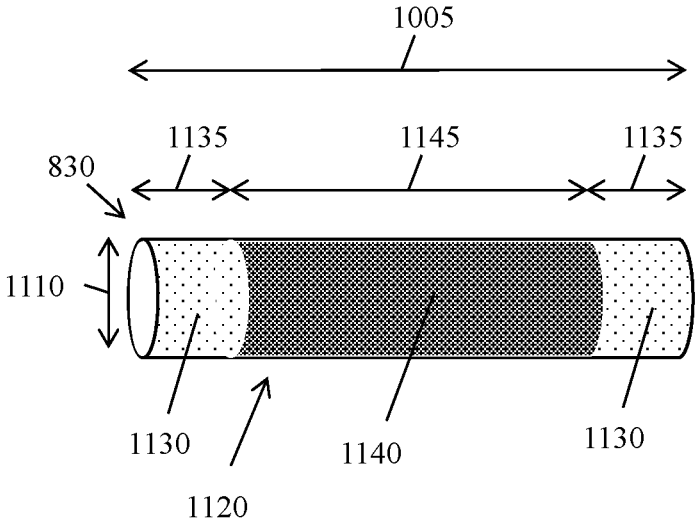
FIG. 11B shows an anilox roll with low surface energy zones for a subsequent flexographic printing station in accordance with one or more embodiments of the present invention.

FIG. 11B shows an anilox roll 830 with low surface energy zones 1130 for a subsequent flexographic printing station (e.g., 2$^{nd}$ through n$^{th}$ 800 of FIG. 9) in accordance with one or more embodiments of the present invention. In one or more embodiments of the present invention, anilox roll 830 includes one or more low surface energy zones 1130 and one or more ink transfer zones 1140. The one or more ink transfer zones 1140 comprise a plurality of cells (not independently illustrated) configured to transfer ink (e.g., 880 of FIG. 8) to a flexographic printing plate (not shown) during flexographic printing operations. The one or more low surface energy zones 1130 are configured to reduce or eliminate bounce and reduce or eliminate the transfer of ink to a flexographic printing plate and ultimately a substrate (e.g., 410 of FIG. 9) in certain areas, thereby increasing useable space on substrate (e.g., 410 of FIG. 9) and reducing material costs.

Anilox roll 830 includes a rigid cylinder (not independently illustrated) constructed of steel, a carbon fiber composite, a carbon fiber composite covered with metal or chrome, or an aluminum core covered with metal, such as steel, or other material, or combinations thereof. One of ordinary skill in the art will recognize that the composition of the cylinder may vary in accordance with one or more embodiments of the present invention. The cylinder may have a length 1005 that varies based on an application or design. The cylinder may have a diameter 1110 that also varies based on an application or design. One or more roller mounts (not shown) may be disposed on the distal ends of the cylinder to secure and rotate anilox roll 830 as part of flexographic printing operations. Advantageously, anilox roll 830 may be substantially similar, from a size perspective, to the anilox roll (e.g., 830 of FIG. 11A) of the first flexographic printing station.

In certain embodiments, the one or more low surface energy zones 1130 may be formed on a portion or portions of a curved contact surface 1120 of the cylinder. The curved contact surface 1120 is the surface around the body of the cylinder that spans the entire length 1005 of the cylinder. Each of the one or more low surface energy zones 1130 extend around the body of the cylinder and span a length 1135 that may vary based on an application or design. Each of the one or more low surface energy zones 1130 may be formed by a hydrophobic surface (not independently illustrated) with a contact angle of at least 75 degrees, preferably greater than 90 degrees, and a surface roughness, $R_a$, of less than 100 micrometers. The contact angle is the angle, typically measured through a liquid (e.g., ink 880), where a liquid/vapor interface meets a solid surface (e.g., the curved contact surface 1120 of the cylinder). The contact angle may be measured using, for example, a goniometer, a microscope, or an optical measurement system. The contact angle may be used to quantify the wettability of a solid surface by a liquid using, for example, Young's equation. Generally speaking, as the contact angle increases, the wettability of the solid surface decreases. Contact angles greater than 90 degrees are hydrophobic. The surface roughness, $R_a$, is a measure of the texture of the solid surface that may influence the contact angle and wettability. The surface roughness, $R_a$, may be measured by profiling deviations of the solid surface from the ideal surface and taking the arithmetic mean of the absolute values of deviations from ideal. If the solid surface is smooth, there are no deviations from the ideal surface, which promotes hydrophobic behavior. If the solid surface is rough, there are substantive deviations from the ideal surface, which promotes wettability. Because the one or more low surface energy zones 1130 are hydrophobic, anilox roll 830 does not take on or transfer ink in the low surface energy zones 1130 during flexographic printing operations.

In certain embodiments, the hydrophobic surface may be formed by depositing a low surface energy coating (not independently illustrated) on a portion or portions of the curved contact surface 1120 of the cylinder. The low surface energy coating creates low surface energy by self-assembly of a monolayer of molecules. As such, anilox roll 830 does not take on or transfer ink in the one or more low surface energy zones 1130 during flexographic printing operations. The low surface energy coating may be comprised of self-assembling monolayers or a fluoro or hydrocarbon containing functional molecules. One of ordinary skill in the art will recognize that any coating sufficient to create low surface energy may be used in accordance with one or more embodiments of the present invention. The low surface energy coating may be deposited by a brush, dip coating, spin coating, slot die coating, spray coating, chemical deposition methods, and/or physical deposition methods. One of ordinary skill in the art will recognize that other deposition processes may be used in accordance with one or more embodiments of the present invention. The deposited low surface energy coating may have a thickness that may vary based on an application or design and/or the type of coating used. However, the one or more low surface energy zones 1130 formed by application of coating are flush with the one or more ink transfer zones 1140.

In other embodiments, the hydrophobic surface may be formed by a plurality of microscopic structures formed on, or in, a portion or portions of the curved contact surface 1120 of the cylinder. The microscopic structures create low surface energy through their structure. As such, anilox roll 830 does not take on or transfer ink in the one or more low surface energy zones 1130 during flexographic printing operations. The microscopic structures may include, for example, similar patterns to those found on lotus leafs, micro pillars, and other geometric structures that are hydrophobic. One of ordinary skill in the art will recognize that any other microscopic structure that creates low surface energy through structure may be used in accordance with one or more embodiments of the present invention.

In still other embodiments, the hydrophobic surface may be formed by a surface having a low surface roughness on a portion or portions of the curved contact surface 1120 of the cylinder. Low surface roughness creates low surface energy because its smoothness prevents the adhesion of ink, such that anilox roll 830 does not take on or transfer ink in the one or more low surface energy zones 1130. The low surface roughness may be achieved by polishing a portion of the curved contact surface to achieve the desired surface roughness. One of ordinary skill in the art will recognize that low surface roughness may be attained through other processes in accordance with one or more embodiments of the present invention.

In still other embodiments, the hydrophobic surface may be formed by a low surface energy coating and a plurality of microscopic structures formed on a portion or portions of the curved contact surface 1120 of the cylinder using techniques such as micro-embossing.

In still other embodiments, the hydrophobic surface may be formed by a low surface energy coating having a low surface roughness formed on a portion or portions of the curved contact surface 1120 of the cylinder.

The plurality of cells may be formed on, or in, one or more ink transfer zones 1140 formed on, or in, a different portion of the curved contact surface 1120 of the cylinder than the one or more low surface energy zones 1130. Each cell is a small indentation of a predetermined geometry that holds and meters the amount of ink (e.g., 880 of FIG. 8) that is transferred to a flexographic printing plate (e.g., 860*a* of FIG. 10A) during flexographic printing operations. The plurality of cells extend around the body of the cylinder and span the length 1145 of the one or more ink transfer zones 1140. In certain embodiments, a size and/or a shape of the predetermined geometry may be selected to meter a desired volume of ink for a given flexographic printing operation. The predetermined geometry may be hexagonal, elongated hexagons, tri-helical, pyramid, inverted pyramid, quadrangular, or any other shape or pattern. One of ordinary skill in the art will recognize that the size and/or the shape of the cells may vary in accordance with one or more embodiments of the present invention. In certain embodiments, each cell may hold approximately 0.3 BCM or less of ink. In other embodiments, each cell may hold approximately 0.5 BCM or less of ink. In still other embodiments, each cell may hold approximately 1 BCM or less of ink. In still other embodiments, each cell may hold more than approximately 1 BCM of ink. One of ordinary skill in the art will recognize that the amount of ink held may vary based on an application or design in accordance with one or more embodiments of the present invention.

In certain embodiments, the portion or portions of the curved contact surface 1120 corresponding to the one or more ink transfer zones 1140 may be polished smooth and a hard ceramic coating (not independently illustrated) may be deposited on it. After deposition, the hard ceramic coating may also be polished smooth. The plurality of cells (not independently illustrated) may be patterned into the hard ceramic coating, but do not extend into the cylinder itself, forming the one or more ink transfer zones 1140.

In other embodiments, a first coating material (not shown) may be deposited over the portion or portions of a curved contact surface 1120 corresponding to the one or more ink transfer zones 1140, forming a thin and smooth layer of first coating material. The deposited first coating eliminates the need to polish the surface of the cylinder smooth prior to deposition. The first coating material may be composed of chromium, copper, nickel, tungsten, titanium, molybdenum, other metals, or alloys thereof. The first coating material may be deposited by, for example, a CVD process, a PECVD process, an APCVD process, or a PVD process including sputtering and electron beam evaporation. The deposited first coating may have a thickness in a range between approximately 1 nanometer and several micrometers. The plurality of cells (not independently illustrated) may be patterned into the cylinder itself, through the first coating material, forming the one or more ink transfer zones 1140. Because the patterned plurality of cells extend into the cylinder, they form stronger common walls between adjacent cells. As a consequence, smaller cells capable of metering smaller volumes of ink may be used and the reliability and usable life of anilox roll 830 may be extended. Smaller volumes of ink are advantageous when printing micrometer-fine lines or features on substrate. A second coating material (not shown) may be deposited over the patterned contact surface of the cylinder to protect the cells and/or enhance ink transfer. The second coating material may be composed of oxides, nitrides, borides, and carbides of metals including, but not limited to, aluminum, cerium, zirconium, hafnium, titanium, tungsten, molybdenum, and intermetallic compounds. The second coating material may be deposited by, for example, a CVD process, a PECVD process, an APCVD process, or a PVD process including sputtering and electron beam evaporation. The deposited second coating may have a thickness in a range between approximately 1 nanometer and several micrometers.

Figure 12:
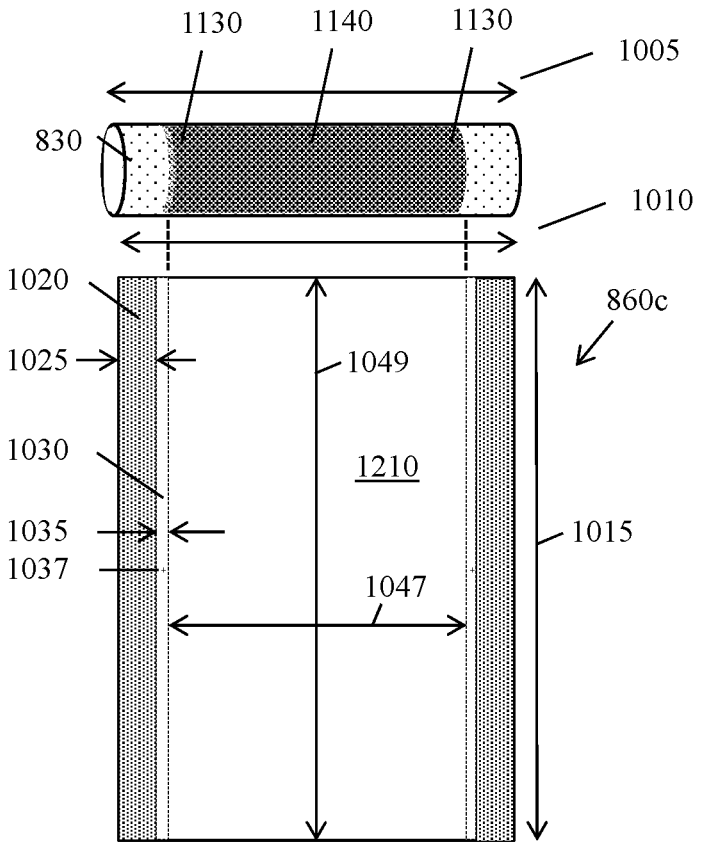
FIG. 12 shows an anilox roll with low surface energy zones and a flexographic printing plate for a subsequent flexographic printing station in accordance with one or more embodiments of the present invention.

FIG. 12 shows an anilox roll 830 with low surface energy zones 1130 and a flexographic printing plate 860*c* for a subsequent flexographic printing station (e.g., $2^{nd}$ through $n^{th}$ 800 of FIG. 9) of a multi-station flexographic printing system (e.g., 900 of FIG. 9) in accordance with one or more embodiments of the present invention. As noted above, anilox roll 830 may be substantially the same size as the anilox roll (e.g., 830 of FIG. 10A) of the first flexographic printing station (e.g., $1^{st}$ station 800 of FIG. 9). For example, anilox roll 830 may have a length 1005 that corresponds to the length (e.g., 1005 of FIG. 10A) of the anilox roll (e.g., 830 of FIG. 10A) of the first flexographic printing station. As a consequence, flexographic printing plate 860*c* may also be substantially the same size as the flexographic printing plate (e.g., 860*a* of FIG. 10A) of the first flexographic printing station (e.g., $1^{st}$ 800 of FIG. 9). For example, flexographic printing plate 860*c* may have a width 1010 that corresponds to the width (e.g., 1010 of FIG. 10A) of the first flexographic printing plate (e.g., 860*a* of FIG. 10A) of the first flexographic printing station.

In certain embodiments, the one or more low surface energy zones 1130 may be formed in an area of anilox roll 830 that corresponds to where contact with the flexographic printing plate 860*c* may be desired, but ink transfer to the flexographic printing plate and substrate is not. For example, the one or more low surface energy zones 1130 may be formed in an area of anilox roll 830 that contacts the one or more bearer bars 1020 and the one or more optical registration tracks 1030. Because the low surface energy of the one or more low surface energy zones 1130 do not take on or transfer ink (e.g., 880 of FIG. 8) to the corresponding areas of flexographic printing plate 860*c*, flexographic printing plate 860*c* does not transfer ink to the corresponding areas of the substrate (e.g., 410 of FIG. 9).

Advantageously, the one or more low surface energy zones 1130 may make contact with flexographic printing plate 860*c* in, for example, the one or more bearer bars 1020 area, but do not transfer ink to the one or more bearer bars 1020. As a consequence, flexographic printing plate 860*c* does not print expensive catalytic ink on substrate in the area corresponding to the one or more bearer bars 1020, even though it may make contact with the same area. This substantially reduces the material cost for expensive catalytic ink and also reduces material costs associated with metallizing the printed catalytic ink on substrate. Because the one or more bearer bars 1020 are not printed on substrate by the one or more subsequent flexographic printing stations (e.g., $2^{nd}$ through $n^{th}$ 800 of FIG. 9), the printed image on substrate of the one or more bearer bars is limited to non-catalytic ink (printed by the first flexographic printing station) that is not metallized during metallization. Advantageously, flexographic printing plate has an image printing area 1210 that is substantially the same size as that of reserved image area (e.g., 1045 of FIG. 10A) of the first flexographic printing plate (e.g., 860*a* of FIG. 10A) of the first flexographic printing station (e.g., $1^{st}$ 800 of FIG. 9). As a consequence, more space may be available for printing on substrate.

Figure 13:
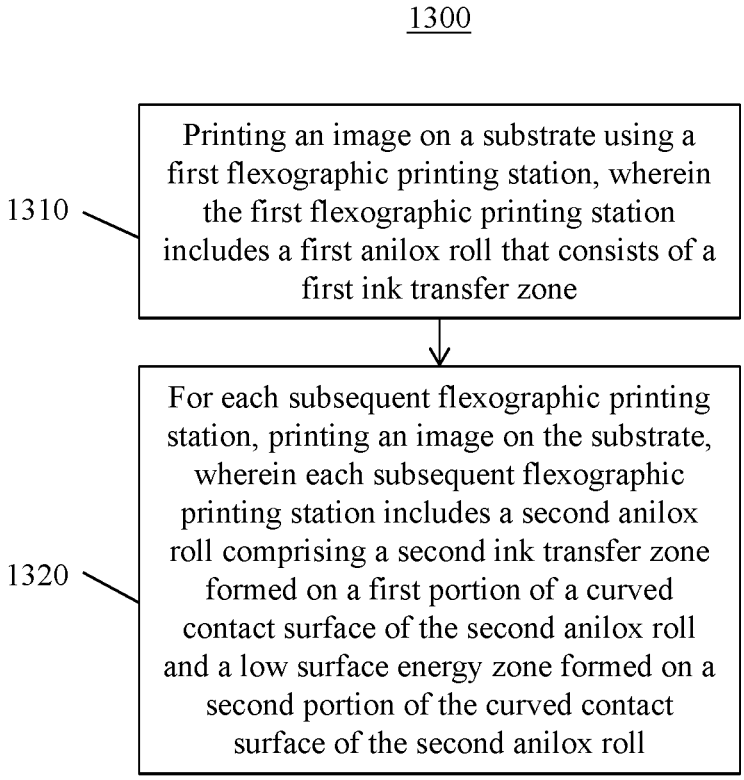
FIG. 13 shows a method of multi-station flexographic printing in accordance with one or more embodiments of the present invention.

FIG. 13 shows a method 1300 of multi-station flexographic printing in accordance with one or more embodiments of the present invention. In certain embodiments, a multi-station flexographic printing system (e.g., 900 of FIG. 9) includes a plurality of flexographic printing stations (e.g., 910 of FIG. 9) that are configured to print on one or more sides of a transparent substrate in sequential order. In applications where the multi-station flexographic printing system is configured to print on opposing sides of the same transparent substrate, one or more of the plurality of flexographic printing stations may be configured to print on a first side of the transparent substrate and one or more of the plurality of flexographic printing stations may be configured to print on a second side of the transparent substrate. In other embodiments, a multi-station flexographic printing system may include a plurality of flexographic printing stations where only a subset of the plurality of flexographic printing stations are configured to print on one or more sides of a transparent substrate in sequential order. One of ordinary skill in the art will recognize that the configuration of a multi-station flexographic printing system may vary based on an application or design in accordance with one or more embodiments of the present invention.

The multi-station flexographic printing system may include a number of flexographic printing stations where the number varies based on an application or design. In certain embodiments, a first flexographic printing station may be used to print a non-catalytic ink image on substrate of one or more bearer bars and/or one or more registration marks in an area outside a designated image area, where, for example, an image of a conductive pattern may be printed. The number of subsequent flexographic printing stations may vary based on an application or design. In certain embodiments, the number of subsequent flexographic printing stations may include at least one flexographic printing station for each side of transparent substrate to be printed. In other embodiments, the number of subsequent flexographic printing stations may include a plurality of flexographic printing stations for each side of transparent substrate to be printed. In still other embodiments, the number of subsequent flexographic printing stations may include a plurality of flexographic printing stations for each side of transparent substrate to be printed, where the number of flexographic printing stations for a given side may be determined by the number of micrometer-fine lines or features to be printed having a different width or orientation.

In step 1310, a first flexographic printing station (e.g., $1^{st}$ 800 of FIG. 9) may print an image on substrate, where the first flexographic printing station includes a first anilox roll (e.g., 830 of FIG. 11A) that consists of an ink transfer zone. The ink transfer zone may include a plurality of cells configured to transfer ink to a flexographic printing plate during flexographic printing operations. The plurality of cells of the ink transfer zone extend around the body of the first anilox roll and span the length of the first anilox roll. Each cell of the plurality of cells may be configured to transfer a volume of ink that may vary based on an application or design. The image printed on substrate may serve a functional purpose for flexographic printing operations, but serve no functional purpose (i.e., electrical connectivity) on substrate once finalized. As a consequence, the first flexographic printing station may be configured to print a non-catalytic ink image on the substrate, which is not metallized by a subsequent metallization process. For example, the first flexographic printing station may print one or more bearer bars and one or more optical registration marks on one or more sides of the substrate using inexpensive non-catalytic ink. The one or more bearer bars may reduce or eliminate bounce during flexographic printing operations, but serve no functional purpose on substrate and the printed image of the bearer bars may be cut off when the substrate is finalized. The one or more optical registration marks may also serve a purpose during flexographic printing operations, but serve no functional purpose on the substrate and the printed image of the one or more optical registration marks may be cut off when the substrate is finalized.

In step 1320, for each subsequent flexographic printing station (e.g., $2^{nd}$ through $n^{th}$ 800 of FIG. 9), a subsequent flexographic printing station may print an image on the substrate. Each subsequent flexographic printing station includes a second anilox roll (e.g., 830 of FIG. 11B) that has at least one ink transfer zone formed on a first portion of a curved contact surface of the second anilox roll and at least one low surface energy zone formed on a second portion of the curved contact surface of the second anilox roll. The at least one ink transfer zone includes a plurality of cells configured to transfer ink to a flexographic printing plate during flexographic printing operations. The at least one low surface energy zone may be configured to reduce or eliminate the transfer of ink to the flexographic printing plate and from the flexographic printing plate to substrate in certain areas, maximizing useable space on substrate, while reducing or eliminating bounce. The low surface energy zone includes a hydrophobic surface having a contact angle of at least 75 degrees, preferably greater than 90 degrees and a surface roughness, $R_a$, of less than 100 micrometers. Because the at least one low surface energy zone is hydrophobic, the second anilox roll does not take on or transfer ink in the at least one low surface energy zone during flexographic printing operations.

In certain embodiments, the hydrophobic surface may be formed by depositing a low surface energy coating on a portion or portions of the curved contact surface of the cylinder. In other embodiments, the hydrophobic surface may be formed by a plurality of microscopic structures formed on, or in, a portion or portions of the curved contact surface of the cylinder. In still other embodiments, the hydrophobic surface may be formed by a surface having a low surface roughness on a portion or portions of the curved contact surface of the cylinder. In still other embodiments, the hydrophobic surface may be formed by a low surface energy coating and a plurality of microscopic structures formed on a portion or portions of the curved contact surface of the cylinder. In still other embodiments, the hydrophobic surface may be formed by a low surface energy coating having a low surface roughness formed on a portion or portions of the curved contact surface of the cylinder. One of ordinary skill in the art will recognize that the hydrophobic surface may be formed in other ways in accordance with one or more embodiments of the present invention.

The plurality of cells may be formed on, or in, the at least one ink transfer zone formed on, or in, a different portion of the curved contact surface of the cylinder than the at least one low surface energy zone. Each cell is a small indentation of a predetermined geometry that holds and meters the amount of ink that is transferred to a flexographic printing plate during flexographic printing operations. The plurality of cells extend around the body of the cylinder and span the length of the at least one second transfer zone. In certain embodiments, a size and/or a shape of the predetermined geometry may be selected to meter a desired volume of ink for a given flexographic printing operation. The predetermined geometry may be hexagonal, elongated hexagons, tri-helical, pyramid, inverted pyramid, quadrangular, or any other shape or pattern. One of ordinary skill in the art will recognize that the size and/or the shape of the cells may vary in accordance with one or more embodiments of the present invention.

Advantages of one or more embodiments of the present invention may include one or more of the following:

In one or more embodiments of the present invention, an anilox roll with a low surface energy zone includes at least one ink transfer zone and at least one low surface energy zone. The low surface energy zone has a hydrophobic surface with a contact angle of at least 75 degrees and a surface roughness, $R_a$, of less than 100 micrometers.

In one or more embodiments of the present invention, an anilox roll with a low surface energy zone provides a hydrophobic surface on a portion of a curved contact surface of the anilox roll that does not absorb ink or other material and does not transfer ink or other material to a flexographic printing plate during flexographic printing operations. In turn, that corresponding portion of the flexographic printing plate does not print on substrate.

In one or more embodiments of the present invention, an anilox roll with a low surface energy zone includes a hydrophobic surface formed by a low surface energy coating.

In one or more embodiments of the present invention, an anilox roll with a low surface energy zone includes a hydrophobic surface formed by a plurality of microscopic structures.

In one or more embodiments of the present invention, an anilox roll with a low surface energy zone includes a hydrophobic surface formed by smoothing the surface to a low surface roughness.

In one or more embodiments of the present invention, an anilox roll with a low surface energy zone includes a hydrophobic surface formed by a low surface energy coating and a plurality of microscopic structures.

In one or more embodiments of the present invention, an anilox roll with a low surface energy zone includes a hydrophobic surface formed by smoothing a low surface energy coating disposed on the anilox roll to a low surface roughness.

In one or more embodiments of the present invention, an anilox roll with a low surface energy zone reduces manufacturing expense, manufacturing time, and manufacturing complexity.

In one or more embodiments of the present invention, an anilox roll with a low surface energy zone is compatible with existing flexographic printing processes.

In one or more embodiments of the present invention, a method of multi-station flexographic printing includes at least one flexographic printing station having an anilox roll with at least one low surface energy zone. A first flexographic printing station may have a first anilox roll that consists of a first ink transfer zone that spans a curved contact surface of the first anilox roll. Each subsequent flexographic printing station includes an anilox roll with at least one low surface energy zone disposed on a portion of a curved contact surface of the anilox roll. The anilox roll with low surface energy zone may have similar dimensions to that of the first anilox roll.

In one or more embodiments of the present invention, a method of multi-station flexographic printing includes at least one flexographic printing station having an anilox roll with at least one low surface energy zone. A first flexographic printing station may have a first anilox roll that consists of a first ink transfer zone that spans a curved contact surface of the first anilox roll. Each subsequent flexographic printing station includes an anilox roll with at least one low surface energy zone. The low surface energy zone may be disposed on a portion of a curved contact surface of the anilox roll, where the portion corresponds to a non-printing area of a corresponding flexographic printing plate. The low surface energy zone does not absorb or transfer ink, but makes sufficient contact with a flexographic printing plate to prevent bounce during flexographic printing operations. As a consequence, subsequent flexographic printing stations may use flexographic printing plates that have bearer bars disposed in the same location as the first flexographic printing station, but ink or other material is not transferred to substrate by the subsequent flexographic printing stations. Expensive catalytic ink or other materials are not used in, for example, bearer bars on subsequent flexographic printing stations. Because subsequent flexographic printing stations do not print catalytic ink or other material in, for example, bearer bars, subsequent to flexographic printing, the area corresponding to the bearer bars on substrate are not metallized by a metallization process, saving expense during metallization.

In one or more embodiments of the present invention, a method of multi-station flexographic printing reduces manufacturing expense, manufacturing time, and manufacturing complexity.

In one or more embodiments of the present invention, a method of multi-station flexographic printing is compatible with flexographic printing processes.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An anilox roll for use in transferring ink to a flexographic printing plate in a flexographic printing system, comprising:

a cylinder having a curved contact surface, the curved contact surface having a length and a circumference;

an ink transfer zone formed on a first portion of the curved contact surface, the ink transfer zone spanning a first segment of the length of the curved contact surface and extending around the circumference of the curved contact surface; and a low surface energy zone formed on a second portion of the curved contact surface, the low surface energy zone spanning a second segment of the length of the curved contact surface and extending around the circumference of the curved contact surface, the second segment of the length of the curved contact surface being distinct from the first segment of the length of the curved contact surface such that the low surface energy zone does not overlap with the ink transfer zone;

wherein the ink transfer zone includes a plurality of cells, the cells being indentations formed on the curved contact surface configured to transfer ink to the flexographic printing plate; and wherein the low surface energy zone has a hydrophobic surface with a contact angle of at least 75 degrees and a surface roughness of less than 100 micrometers, and wherein the low surface energy zone does not include any cells.

2. The anilox roll of claim 1, wherein the hydrophobic surface includes a low surface energy coating.

3. The anilox roll of claim 1, wherein the hydrophobic surface includes a plurality of microscopic structures.

4. The anilox roll of claim 1, wherein the hydrophobic surface includes a smooth surface having a low surface roughness.

5. The anilox roll of claim 1, wherein the hydrophobic surface includes a low surface energy coating and a plurality of microscopic structures.

6. The anilox roll of claim 1, wherein the hydrophobic surface includes a low surface energy coating with a smooth surface having a low surface roughness.

7. The anilox roll of claim 1, wherein the plurality of cells are formed in a first coating disposed in the ink transfer zone of the curved contact surface.

8. The anilox roll of claim 7, wherein a second coating is disposed over the plurality of cells formed in the first coating.

9. The anilox roll of claim 1, wherein each cell is configured to hold a volume of 0.5 BCM of ink or less.

10. The anilox roll of claim 1, wherein each cell is configured to hold a volume of 1.0 BCM of ink or less.

* * * * *